US011131324B2

(12) United States Patent
Ozturk et al.

(10) Patent No.: US 11,131,324 B2
(45) Date of Patent: Sep. 28, 2021

(54) FAN HOUSING FOR REDUCED NOISE

(71) Applicant: Hewlett-Packard Development Company, L.P., Spring, TX (US)

(72) Inventors: Gunay Ozturk, Corvallis, OR (US); Robert Yraceburu, Vancouver, WA (US); Charles Hugh Oppenheimer, Vancouver, WA (US); William Winters, Sumner, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 149 days.

(21) Appl. No.: 16/326,067

(22) PCT Filed: Sep. 2, 2016

(86) PCT No.: PCT/US2016/050193
§ 371 (c)(1),
(2) Date: Feb. 15, 2019

(87) PCT Pub. No.: WO2018/044322
PCT Pub. Date: Mar. 8, 2018

(65) Prior Publication Data

US 2019/0170161 A1 Jun. 6, 2019

(51) Int. Cl.

| | |
|---|---|
| ***F04D 29/66*** | (2006.01) |
| ***F04D 29/42*** | (2006.01) |
| ***F04D 29/38*** | (2006.01) |
| ***F04D 29/52*** | (2006.01) |

(52) U.S. Cl.
CPC ..... *F04D 29/661* (2013.01); *F04D 29/38* (2013.01); *F04D 29/4246* (2013.01); *F04D 29/522* (2013.01); *F04D 29/663* (2013.01); *F05D 2250/52* (2013.01); *F05D 2250/70* (2013.01); *F05D 2250/73* (2013.01)

(58) Field of Classification Search
CPC ..... F04D 29/661; F04D 29/38; F04D 29/522; F04D 29/663; F04D 29/4246; F05D 2250/52; F05D 2250/70; F05D 2250/73
See application file for complete search history.

(56) References Cited

U.S. PATENT DOCUMENTS

| | | | | |
|---|---|---|---|---|
| 3,211,360 A * | 10/1965 | Lyman | F04D 29/441 | 417/423.14 |
| 5,085,057 A * | 2/1992 | Thompson | F24F 13/20 | 165/135 |
| 6,616,722 B1 | 9/2003 | Cartellone | | |
| 7,284,952 B2 * | 10/2007 | Huang | F04D 29/4226 | 415/119 |

(Continued)

FOREIGN PATENT DOCUMENTS

| | | |
|---|---|---|
| CN | 1427220 A | 7/2003 |
| CN | 1465868 A | 1/2004 |

(Continued)

*Primary Examiner* — Woody A Lee, Jr.
*Assistant Examiner* — Maxime M Adjagbe
(74) *Attorney, Agent, or Firm* — Fabian VanCott

(57) ABSTRACT

A fan includes: a housing; and an impeller with an axis and a plurality of blades, the impeller mounted inside the housing; and a plurality of outlets from the housing, each outlet including a cutoff with a top and a bottom. A line between the top and bottom of each cutoff is not parallel to the axis of the impeller.

20 Claims, 11 Drawing Sheets

(56) References Cited

U.S. PATENT DOCUMENTS

| | | | | |
|---|---|---|---|---|
| 8,721,274 | B2 | 5/2014 | Han | |
| 9,145,900 | B2 | 9/2015 | Kim et al. | |
| 9,279,358 | B2 | 3/2016 | Wiegers et al. | |
| 2007/0122271 | A1 | 5/2007 | Ishihara et al. | |
| 2010/0142146 | A1 | 6/2010 | Hwang et al. | |
| 2011/0110774 | A1* | 5/2011 | Horng | F04D 29/582 415/208.1 |
| 2012/0026688 | A1 | 2/2012 | Takemoto et al. | |
| 2015/0147167 | A1* | 5/2015 | DeFilippis | F24F 7/08 415/206 |
| 2015/0330394 | A1 | 11/2015 | Cocks et al. | |

FOREIGN PATENT DOCUMENTS

| | | | |
|---|---|---|---|
| CN | 102345643 | A | 2/2012 |
| CN | 203946283 | U | 11/2014 |
| CN | 104421200 | A | 3/2015 |
| CN | 205119388 | U | 3/2016 |
| JP | 5238760 | | 3/1977 |
| JP | 549006 | | 1/1979 |
| JP | H11132527 | A | 5/1999 |
| SU | 1637047 | | 3/1991 |
| WO | WO2009021356 | A1 | 2/2009 |
| WO | WO-2009065394 | | 5/2009 |
| WO | WO-2015168603 | | 11/2015 |

* cited by examiner

FAN HOUSING FOR REDUCED NOISE

BACKGROUND

Fans are used in many kinds of devices, including printers, to aid in heat transfer. Increased heat transfer is accomplished by increasing the convection of fluid passing over a warm or cold component. The increased convection increases the temperature differential between the component and the nearby fluid. The increased temperature differential between the component and the surrounding fluid increases the rate of heat transfer. Fans may also be used for other air handling operations.

BRIEF DESCRIPTION OF THE DRAWINGS

The accompanying drawings illustrate various examples of the principles described herein and are a part of the specification. The illustrated examples are intended to illustrate and do not limit the scope of the claims. Throughout the drawings, identical reference numbers designate similar, but not necessarily identical, elements.

DETAILED DESCRIPTION

Various aspects of fan operation may produce noise, which is unwanted sound. Specifically, the increased fluid flow induced by fans may produce noise. The electrical motor powering the fan may produce noise. The rotation of the impeller on its bearings may produce noise. The movement of air may produce noise. The interaction of airflow with flow directing features may also produce noise, often more than the airflow alone.

In particular, the blades of the impeller passing close to a flow directing feature may produce tonal noise arising from periodic interactions between airflow wakes generated by individual impeller blades and flow directing features. Tonal noise is noise with one or more consistent tones. Tonal noise may be particularly objectionable because of heightened human awareness and sensitivity to tonal noise. Tonal sound of a given loudness is generally more noticeable to human hearing than non-tonal sound of the same loudness level. Accordingly, it is desirable to reduce the noise, and particularly the tonal noise, produced by fans.

During development of a multiple outlet impeller fan, it was discovered that noise was produced by both outlets. If the outlets have similar geometries, their noise profiles tend to be additive. Thus, the present specification explores how to reduce the noise profile of each outlet as well as the system as a whole.

As used in this specification and the associated claims, the term "cutoff" refers to the downstream edge of the housing where the impeller blades pass behind the housing. The use of a cutoff parallel to the axis of the impeller is associated with greater blade pass tonal noise. In contrast, if the cutoff covers the outer edge of multiple blades, the tonal noise is reduced, with three or more blades being preferable.

Among other examples, this specification describes a fan that includes a housing; and an impeller with an axis and a plurality of blades, the impeller mounted inside the housing; a plurality of outlets from the housing, each outlet comprising a cutoff with a top and a bottom. A line between the top and bottom of each cutoff is not parallel to the axis of the impeller.

This specification also describes, a housing for a fan, the housing including: a first output port with a first cutoff; and a second output port with a second cutoff, wherein the first cutoff is shaped relative to a direction of flow of fluid exiting the first output port.

This disclosure also describes a method of operating a fan with multiple output ports, the method including: producing a first audio profile from the output of a first output port; and producing a second audio profile form the output of a second output port. The first and second audio profiles differ from each other so as to reduce the peak of the combined audio profile of the fan.

Figure 1:
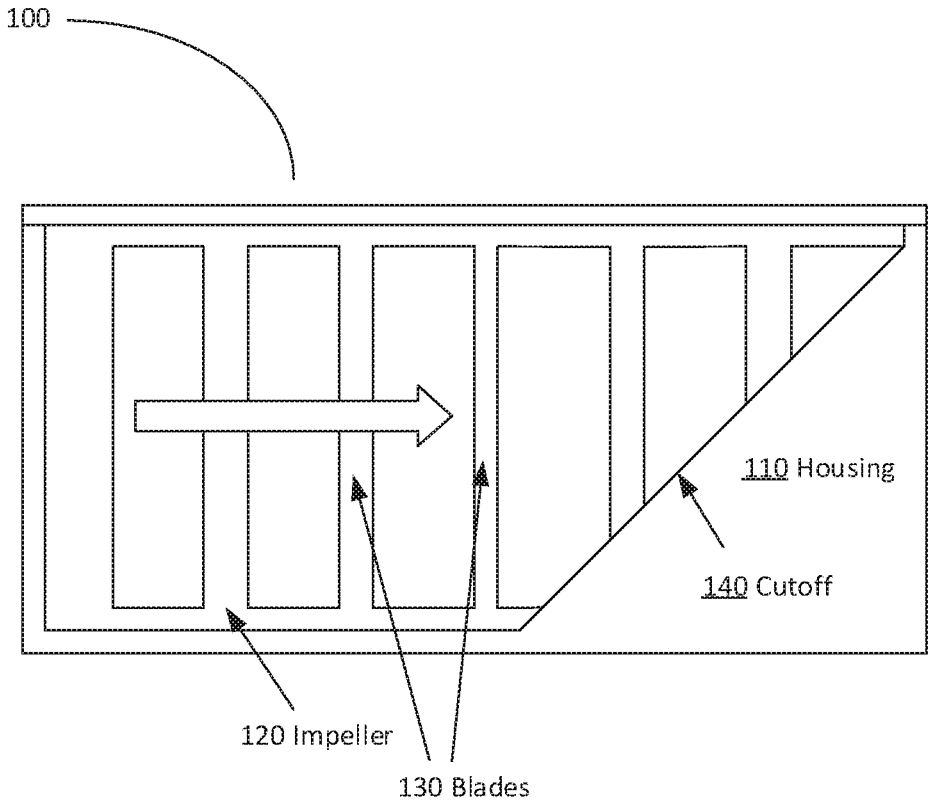
FIG. 1 shows a side view through an output port of a fan according to one example of the principles described herein.

Turning to the figures, FIG. 1 shows a side view through an output port of a fan (100) according to one example of the principles described herein. The fan (100) includes a housing (110) and an impeller (120). The impeller (120) has a plurality of blades (130) which rotate in the direction shown by the arrow. The output port is formed by the housing (110) and includes a cutoff (140). A line connecting the top and bottom of the cutoff (140) is not vertical, i.e. parallel to the rotational axis of the impeller. Instead, the bottom end is extended left toward the middle of the figure and the downstream edge of the output port (140) is shaped. In this example, the cutoff geometry creates a wedge shaped opening in the downstream part of the output port.

The fan (100) may operate with an electrical motor. The fan (100) may operate predetermined speeds or may operate continuously over a range of speeds. The speed may be selected to reduce harmonic interaction between the geometry of the housing (110) and the impeller (120) including the blades (130). Generally speaking, increasing the velocity of the impeller (120) increases the overall flow rate of fluid being driven by the fan (100). Motor noise may increase with increasing rotational speed of the impeller (120). Flow noise may increase with increasing fluid flow volumes. Both the level and frequency of tonal blade (130) pass noise may increase with increasing rotation speed of the impeller (120). However, while increasing speed and flow are associated with increased noise, some geometries exhibit less overall noise than others; this is particularly the case for tonal blade pass noise.

Figure 3:
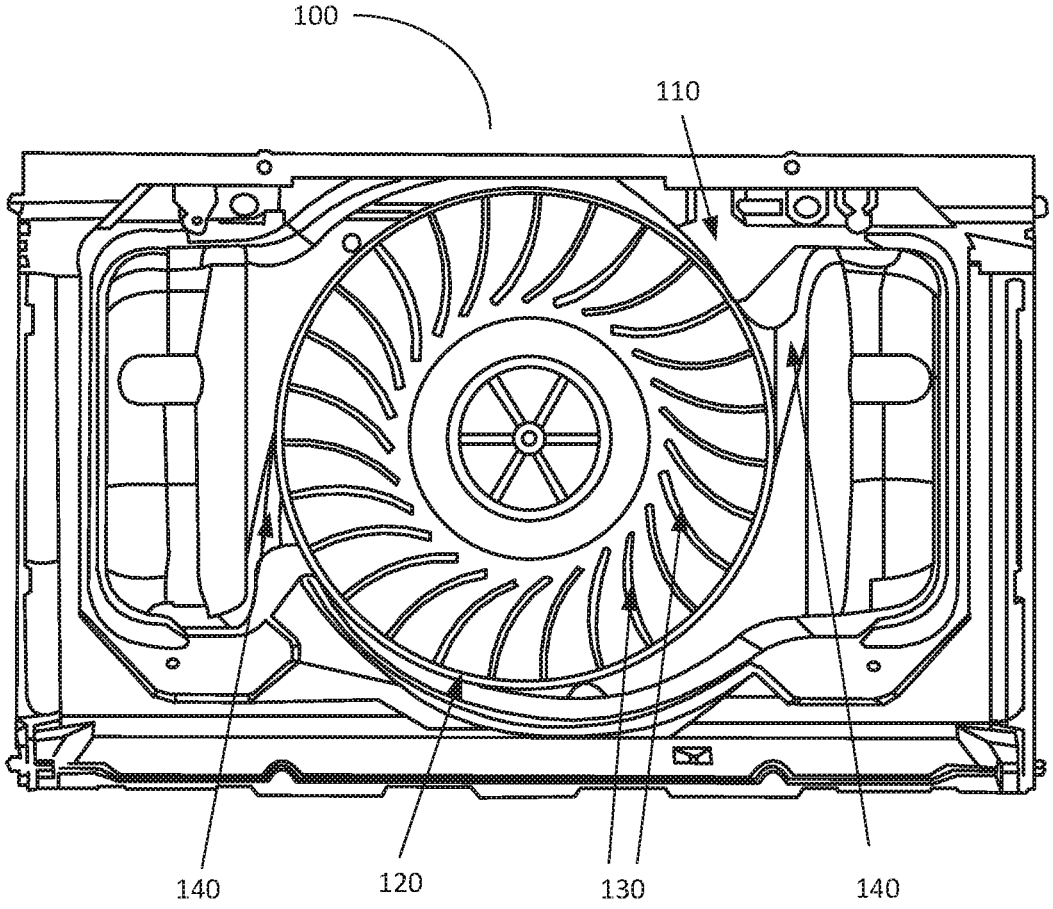
FIG. 3 shows top view of an example of a fan according to the principles described herein.

The housing (110) helps define the flow paths in the fan. The housing (110) is close to impeller and blades at the airflow exit, the high fluid movement rate produces a low pressure that draws fluid into the middle of the impeller (120). The housing (110) opens away from the impeller, forming the volute, to direct the flow of fluid toward the output port as seen in FIG. 3.

In this example, the impeller (120) has a rim on the distal part of the blades (130) from the inlet. The impeller (120) may have a rim on the top, the bottom, both, or neither location.

The blades (130) may be any of a variety of shapes and configurations. The blades (130) may be flat. The blades (130) may be curved, either concave or convex.

The cutoff (140) may be a slope. The cutoff (140) may be a curve. The cutoff (140) may be a more complex geometry.

Testing different geometries for the cutoff (140) has found that noise is strongly reduced when the downstream edge traverses more than one blade (130). In contrast, when the cutoff (140) of the output port covers a single blade (130), one and a half blades (130), or two blades (130) the noise level is not strongly impacted.

The fan (100) may have multiple outlet ports. Selecting the geometries of the cutoffs (140) so they produce different audio profiles may reduce the peak audio output. For example, if geometry A has a peak volume, using geometry A for both outlets will tend to increase the peak volume of the combined volume from the two ports. However, combining geometry A with geometry B with a different audio profile may reduce the stacking of peaks and produce a combined profile with a lower peak noise level.

Figure 2A:
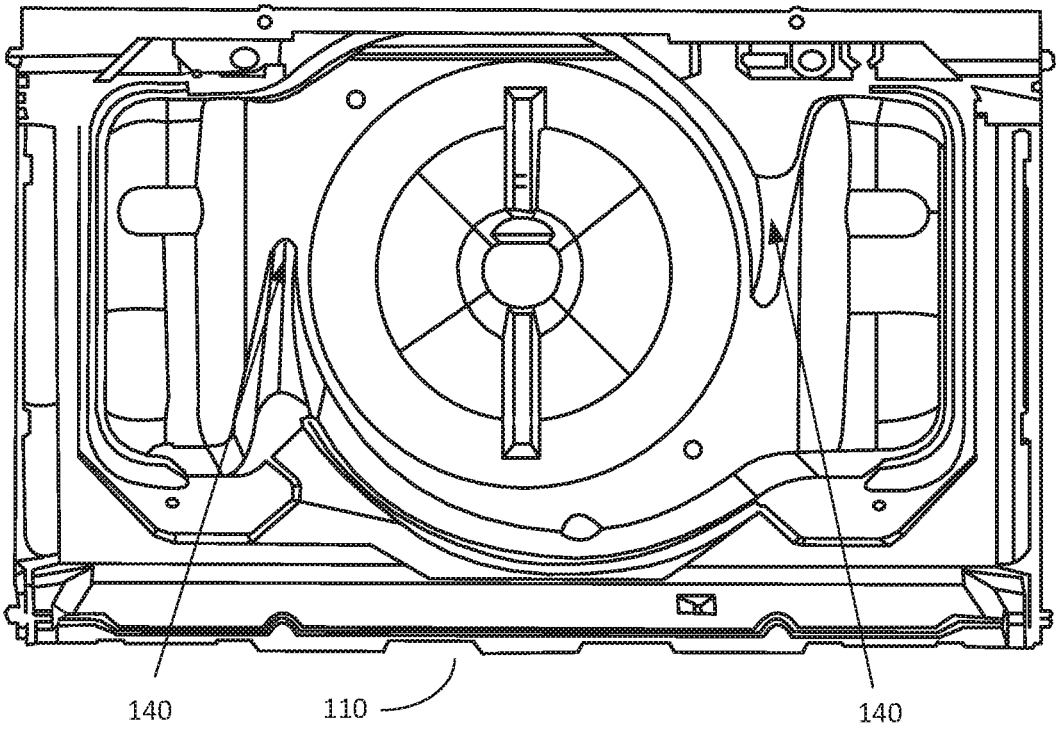
FIG. 2A is a top view of a housing according to one example of the principles described herein.

FIG. 2A is a plan of a housing (110) according to one example of the principles described herein. The housing (110) includes a hole in the center for mounting a motor and the impeller (120). Recessed slots can be seen to facilitate alignment and fixturing of the impeller (120) relative to the housing (110). The pair of larger circles visible in the middle of the housing (110) correspond to the sweep area of the impeller (120). In the view of FIG. 2A, the impeller (120) rotates counter clockwise. Starting at the 3 o'clock position the impeller (120) and the wall of the housing (110) are in close proximity. The wall of the housing (110) gradually separates from the impeller (120) providing a pressure gradient to induce motion in the fluid towards the output port. At approximately 10 o'clock the upstream edge of the opening of the first outlet port is visible and the air is pushed to the first outlet. Between approximately 8 and 9 o'clock the cutoff (140) is visible at the downstream edge of the outlet port. In this example, the cutoff (140) is a slope between the top and the bottom of the housing (110). This cycle is then repeated for the other outlet port.

The described geometry has been found to reduce the tonal noise of the fan (100) relative to a cutoff (140) that is parallel to the axis of the impeller (120). While not wishing to be bound by any particular theory, the tonal noise reduction is believed to result from a weakening of the interaction of the airflow wake of each impeller blade (130) against the cutoff (140) due to temporal and spatial effects. For a parallel cutoff (140), the interaction is abrupt and spans the full length of the trailing edge as the wake generated by the blade (130) quickly passes by the cutoff (140). The interaction between wake and cutoff (140), and hence tonal sound generation, may be reduced by increasing the gap between the blade (130) trailing edge and the volute, but this approach yields an undesirable loss of airflow and fan (100) efficiency. By contrast, a shaped cutoff (140), for example sloped or curved, increases the passage time of the wake across the cutoff (140) by virtue of the cutoff's direction, thereby reducing sound radiation, without compromising fan (100) function. The angled cutoff (140) also reduces the maximum instantaneous area where sound is generated to a set of discrete regions at the gaps between the shaped cutoff (140) and blade (130) trailing edges, according to blade (130) and shaped cutoff geometry (140), that is less than the full blade (130) length region associated with a parallel cutoff (140). A shaped cutoff (140) thus reduces tonal noise by reducing both the efficiency of tonal sound generation and area of tonal sound generation. In one example, the shaped cutoff (140) is sloped. The slope may be between 20 and 60 degrees. The slope may be between 30 and 50 degrees. In one example, the slope is approximately 45 degrees. In the sloped examples, the slope is uniform and continuous from wall to wall of the downstream edge.

The shaped cutoff (140) may be a curve. The curve may have the same mean slope as the slopes described above, for example 20 to 60 degrees. However, in a curve, the angle of the slope changes across the profile rather than being constant and continuous.

In one example, the downstream edges of the first outlet and second outlet have different profiles from each other. For example, one downstream edge may have a 30-degree slope and the other downstream edge have a 60-degree slope.

Figure 2B:
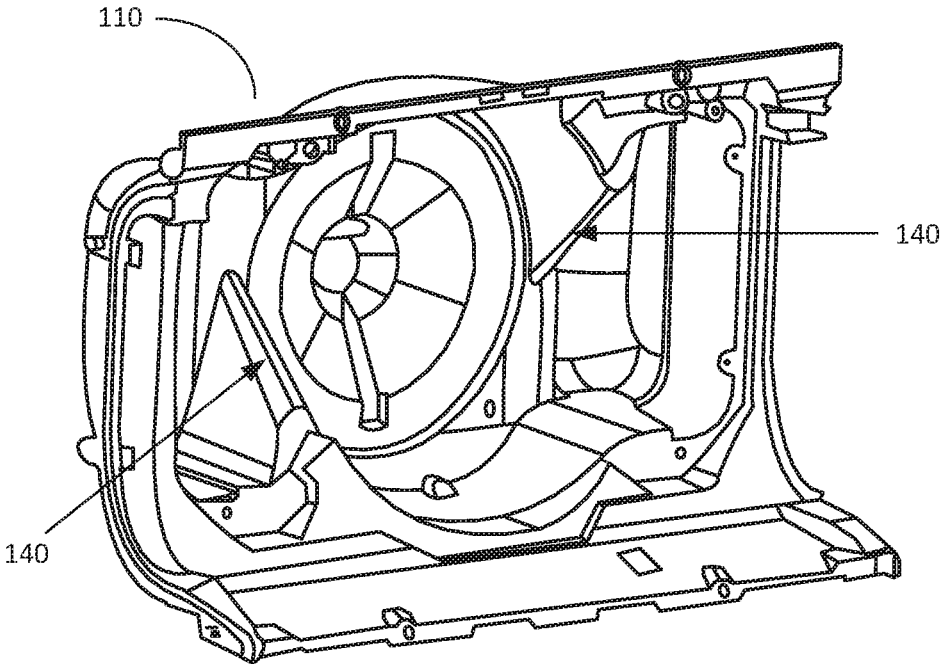
FIG. 2B is an isomorphic view of the same housing.

FIG. 2B shows is an isomorphic view of the housing (110) of FIG. 2A. The housing (110) accommodates multiple output ports from the fan (100), in this case two. The ports are located on opposite sides of the impeller (120). The ports each have an upstream edge and a cutoff (140). The points where the downstream edge of the port meet the top and bottom of the housing (110) do not form a line parallel to the axis of rotation of the impeller. The cutoff (140) is not perpendicular to the direction of rotation the impeller.

FIG. 3 shows a top view of an example of a fan (100) according to the principles described herein. The fan (100) includes a housing (110) containing an impeller (120) with blades (130). The fan (100) includes outlet ports on the left and right of the figure. Each outlet port has an upstream edge and a cutoff (140). The upstream edge is next to the volute, an expanding gap between the housing (110) and the blades (130) of the impeller (120). The cutoff (140) is shaped so that the cutoff (140) is not vertical. Specifically, the point where the cutoff (140) meets the bottom of the housing (110) and the point where the cutoff (140) meets the top of the housing (110) do not form a line parallel to the axis of rotation of the impeller (120). In the present example, the point at the bottom of the housing (110) is displaced so that the downstream edge of the outlet port (140) is not parallel to the axis of the impeller (120).

In this example, the blades (130) of the impeller (120) are concave based on the direction of rotation of the impeller. The blades (130) may be flat. The blades (130) may be convex. The blades (130) may be rectangular. The distal tips of the blades (130) may be tapered. The distal tips of the blades (130) may be rounded. The blades (130) may have a trapezoidal cross section with a concave shape in the direction of rotation.

The blades (130) may be any suitable configuration. However, the use of a concave blade that leans into the direction of rotation as shown in FIG. 3 produces a high efficiency compared with other blade configurations. Blades (130) with a concave orientation and a convex orientation near the intake were also found to be effective at reducing noise and increasing efficiency.

In one example, the blades (130) have a smaller width near the intake and a larger width at the distal edge of the blade (130) from the intake. This is associated with a higher speed of the distal edge of the blade (130) at a given revolutions per minute. The higher speed, in turn, creates a lower pressure helping to draw air down through the intake and away from the intake side of the impeller (120). This approach may be associated with greater efficiency by the fan (100).

Figure 4:
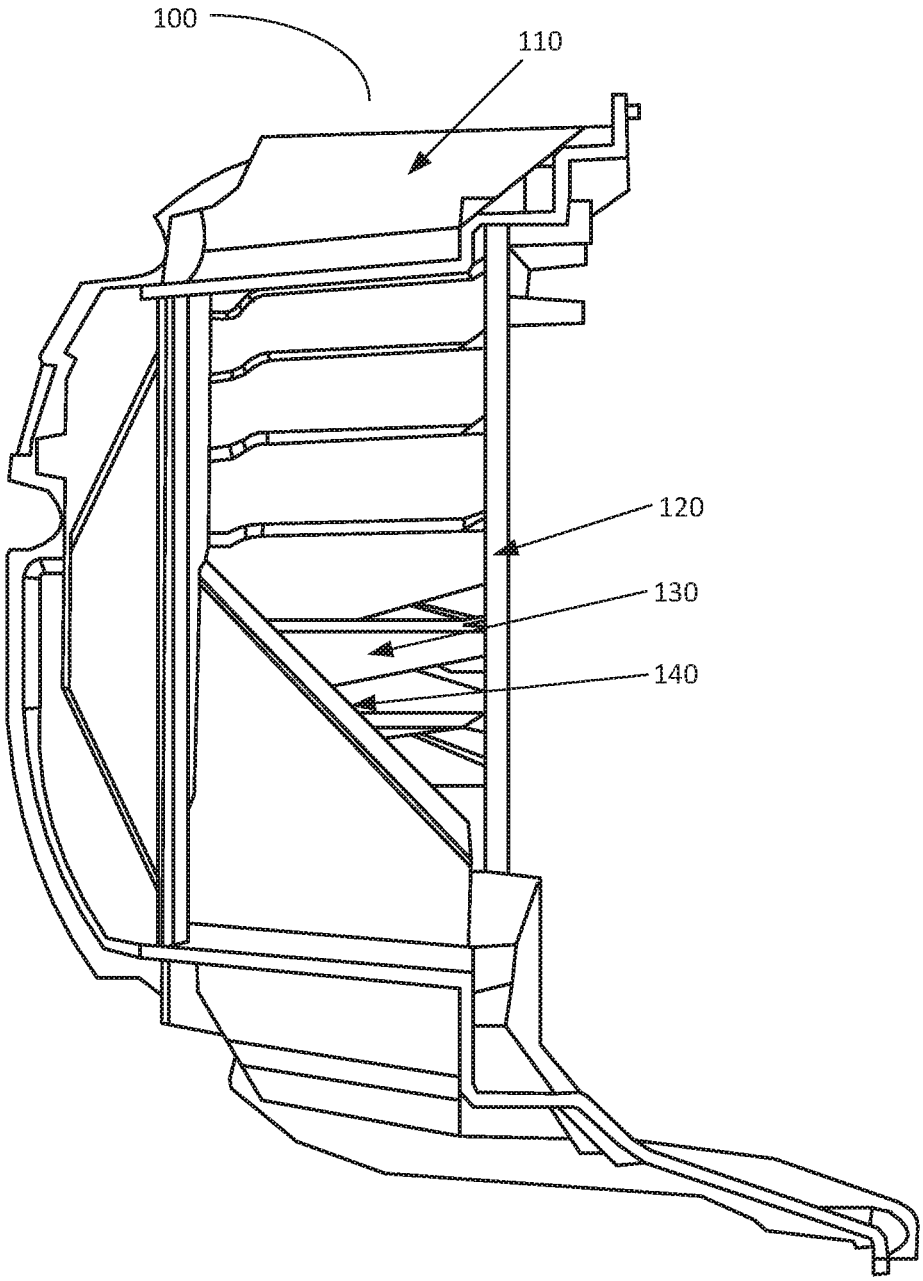
FIG. 4 shows a side view of an example of a fan according to the principles described herein.

FIG. 4 shows a side view of an example of a fan (100) according to the principles described here. The fan (100) includes a housing (110) that contains an impeller (120) with multiple blades (130). The impeller (120) and blades (130) can be seen through an outlet port of the fan (100). The impeller (120) rotates downward as seen in this figure. Accordingly, the cutoff (140) of the outlet is located just below the center of the figure. The cutoff (140) is angled with respect to the top and bottom of the housing (110). The cutoff (140) is angled with respect to the axis of rotation of the impeller (120). The cutoff (140) is angled with respect to the direction of motion of the impeller blades (130), such that at any given time the plane of at least one impeller blade (130) passes through the cutoff (140). Preferably, three or four blades pass through the cutoff (140) at any given point in time. The impeller blades (130) may include a shoulder and/or a buttress. In FIG. 4 a shoulder can be seen on the left side of the impeller blades (130) and a buttress can be seen supporting the connection to a rim on the right side of the impeller blades (130) (as viewed in the figure).

Figure 5:
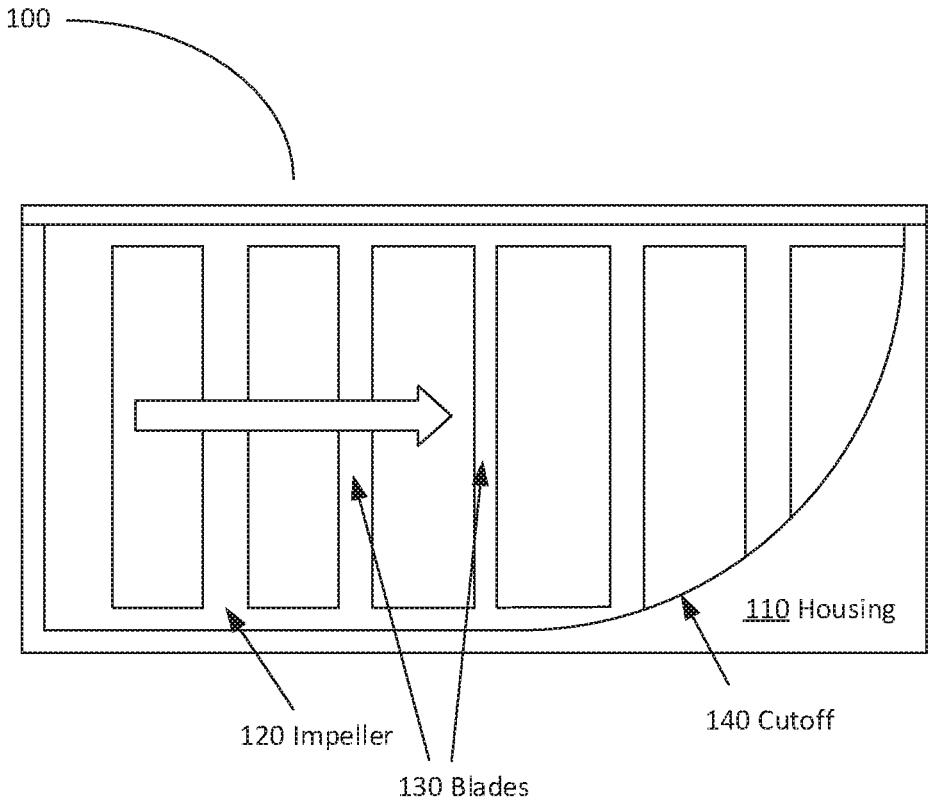
FIG. 5 shows a side view through an output port of a fan according to one example of the principles described herein.

FIG. 5 shows a side view through an output port of a fan (100) according to one example of the principles described herein. The fan (100) includes a housing (110) and an impeller (120) with multiple blades (130). The fan (100) includes multiple outlet ports where each outlet port has a cutoff (140).

In FIG. 5, the cutoff (140) is curved. Specifically, the cutoff (140 is concave. The points where the cutoff (140) intercepts the housing on either side of the cutoff (140) do not form a line parallel to the axis of rotation of the impeller (120). Rather, one side is located ahead of the other in the direction of rotation of the impeller (120).

Figure 6:
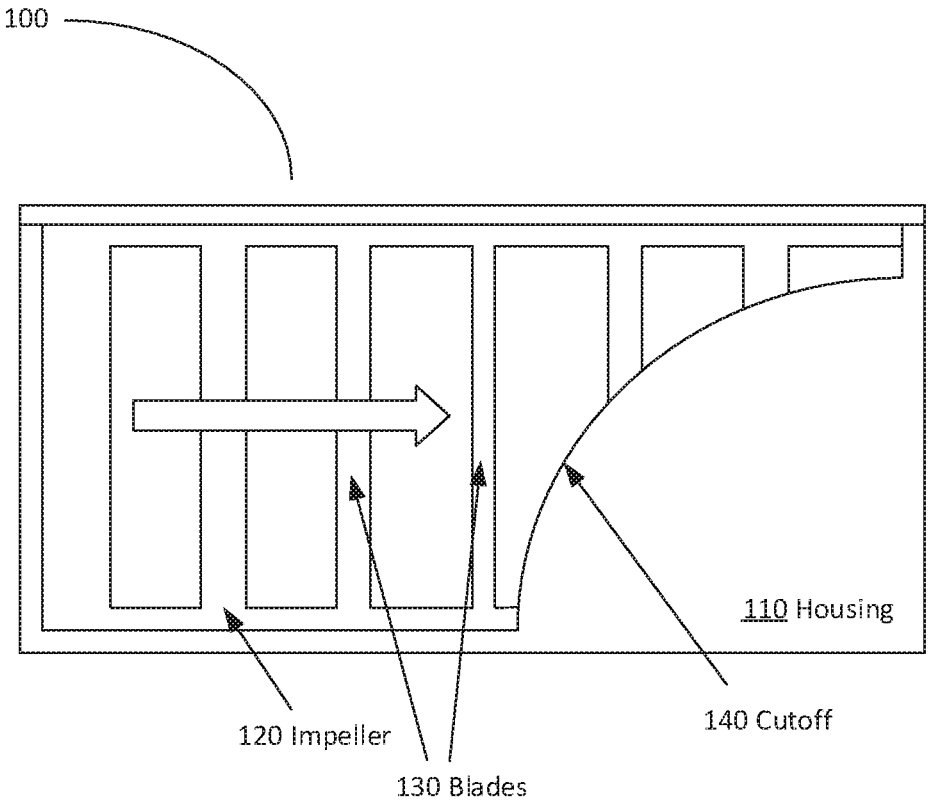
FIG. 6 shows a side view through an output port of a fan according to one example of the principles described herein.

FIG. 6 shows a side view through an output port of a fan (100) according to one example of the principles described herein. The fan (100) includes a housing (110) and an impeller (120) with multiple blades (130). The fan (100) includes multiple outlet ports where each outlet port has a cutoff (140).

In FIG. 6, the cutoff (140) is curved. Specifically, the cutoff (140) is convex. The points where the cutoff (140) intercepts the housing on either side of the cutoff (140) do not form a line parallel to the axis of rotation of the impeller (120). Rather, one side is located ahead of the other in the direction of rotation of the impeller (120).

Figure 7:
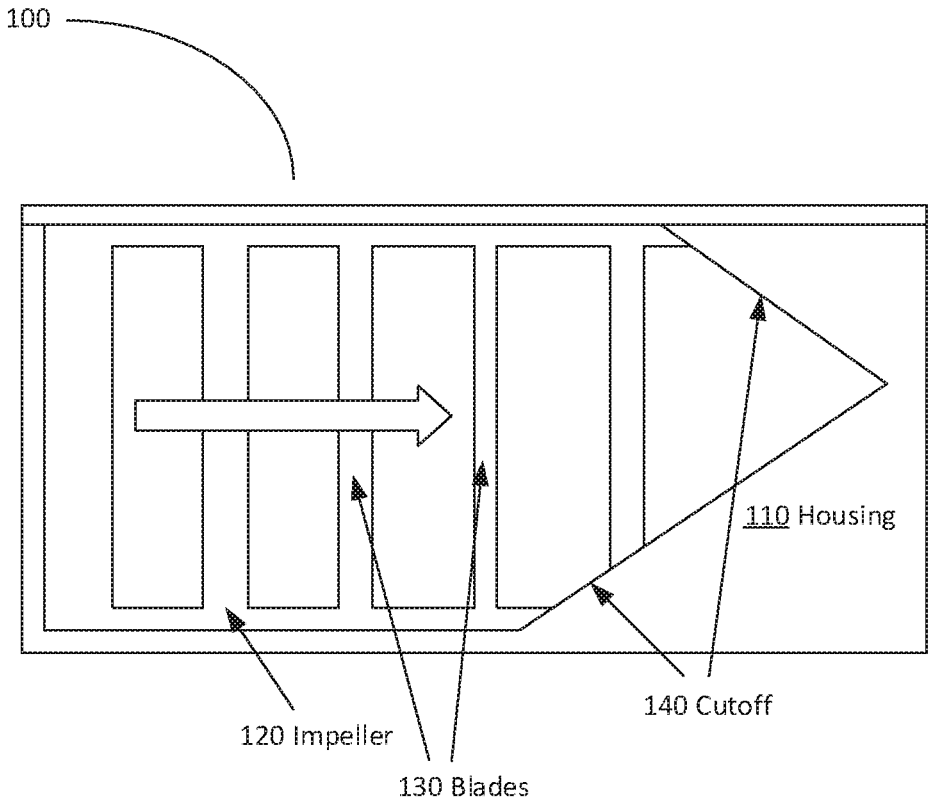
FIG. 7 shows a side view through an output port of a fan according to one example of the principles described herein.

FIG. 7 shows a side view through an output port of a fan (100) according to one example of the principles described herein. The fan (100) includes a housing (110) and an impeller (120) with multiple blades (130). The fan (100) includes multiple outlet ports where each outlet port has a cutoff (140).

In FIG. 7, the cutoff (140) of the outlet port forms a chevron. The points where the cutoff (140) intercepts the housing on either side of the cutoff (140) do not form a line parallel to the axis of rotation of the impeller (120). Rather, one side is located ahead of the other in the direction of rotation of the impeller (120).

Figure 8:
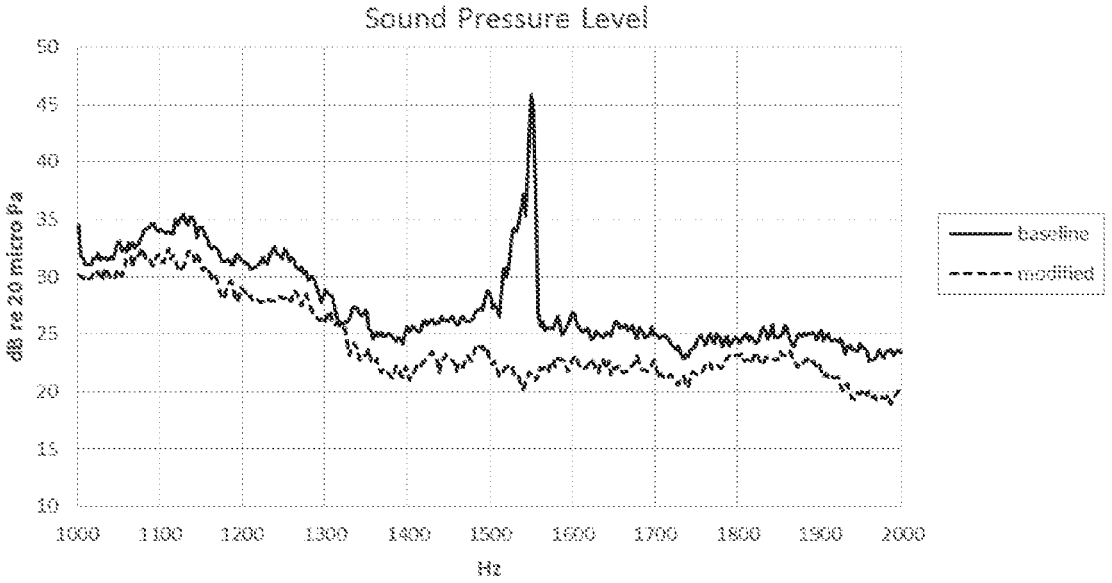
FIG. 8 shows an example of the effect of applying the shaped blade and shaped cutoff principles described herein.

FIG. 8 shows an example of the effect of applying the shaped blade and a shaped cutoff principles described herein. The baseline shows the profile for a cutoff parallel to the axis of the impeller. The modified line shows the profile for a cutoff not parallel to the axis of the impeller. The large peak at 1550 Hz tone of the baseline design is almost not present, having been reduced by roughly 20 dB, demonstrating the effectiveness of these principles.

Figure 9:
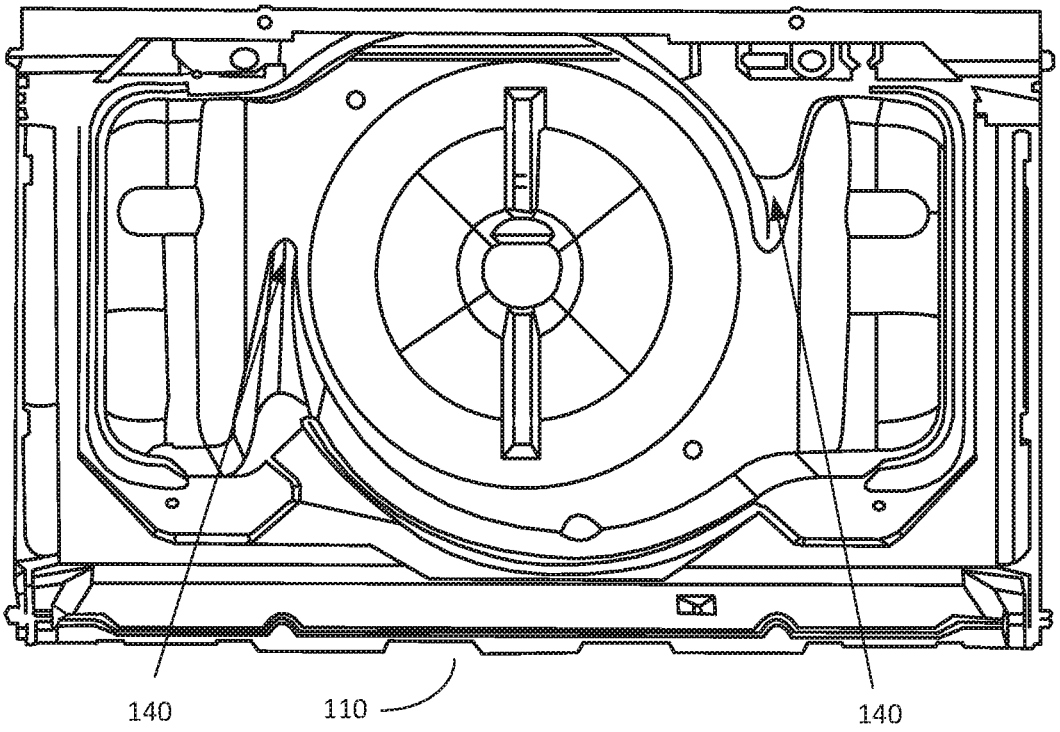
FIG. 9 shows a top view of a fan according to one example of the principles described herein.

FIG. 9 shows a top view of a housing (110) according to one example of the principles described herein. The housing (110) includes two output ports on either side. The output ports each have a cutoff (140). However, the profile of the downstream edge of the first output port and the profile of the downstream edge of the second outlet port differ from each other. Specifically, the cutoff (140) of the port on the right of the figure is shorter than the cutoff (140) of the port on the left. Both downstream edges (140) are not orthogonal to the top and bottom of the housing (110).

In one example, the first downstream edge and the second cutoff (140) are both shaped but with different geometries. For example, the first cutoff (140) may be sloped at approximately 60 degrees while the second cutoff (140) may be sloped at approximately 30 degrees. In a second example, the first and second downstream edges (140) may both be curved but with different profiles. In a third example, the first cutoff (140) may be sloped and the second cutoff (140) may be curved. In a fourth example, the first cutoff (140) may have a chevron style edge while the second cutoff (140) has a different edge shape, for example a curve or a sloped edge.

The use of non-identical or non-symmetrical cutoffs (140) can also be used to adjust the balance between the two output ports. In some cases, tuning of the geometries will allow balanced flow between the outputs. In other cases, stronger flow to one output port may be desired for design reasons.

Figure 10:
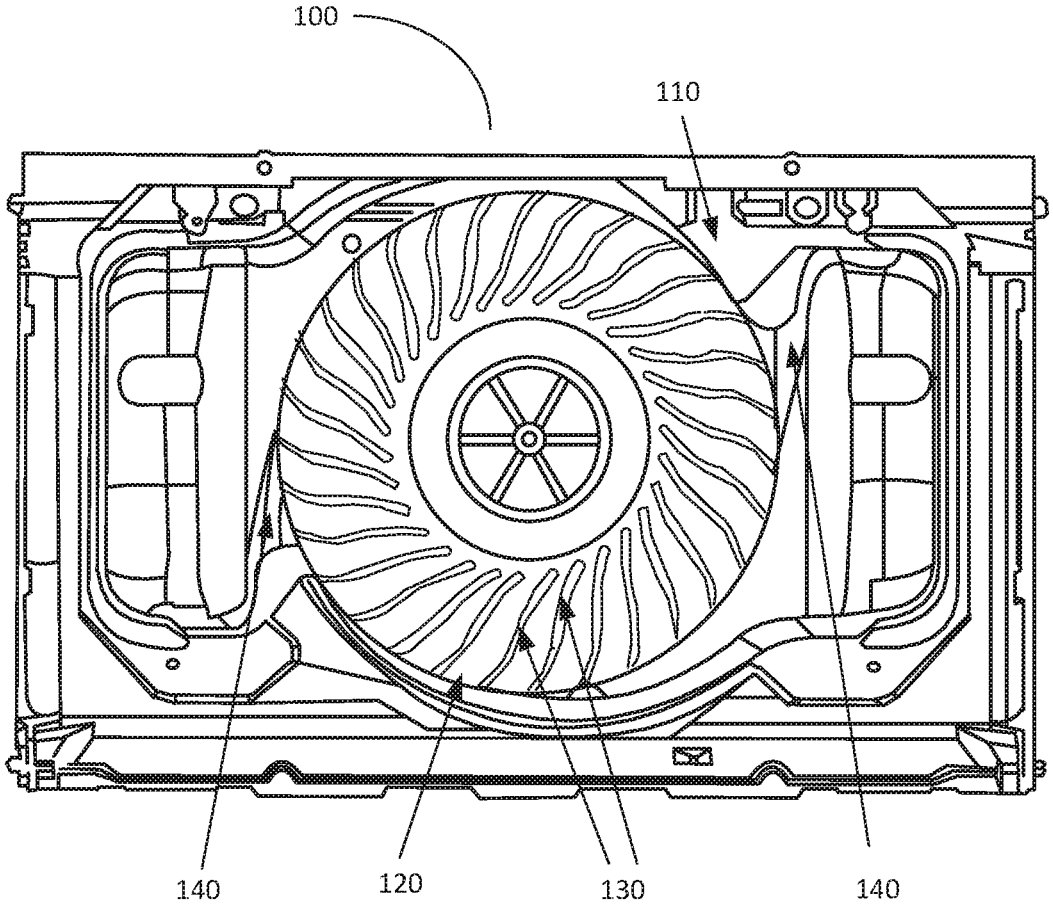
FIG. 10 shows top view of an example of a fan according to the principles described herein.

FIG. 10 shows a top view of an example of a fan (100) according to the principles described herein. The fan (100) includes a housing (110) containing an impeller (120) with blades (130). The fan (100) includes outlet ports on the left and right of the figure. Each outlet port has an upstream edge and a cutoff (140). The upstream edge is next to the volute, an expanding gap between the housing (110) and the blades (130) of the impeller (120). The cutoff (140) is shaped so that the cutoff (140) is not vertical. The cutoff (140) is shaped so that the cutoff (140) is not parallel to the axis of the impeller (120).

FIG. 10 shows a blade design where the blades (130) are base orientation that is the reverse of the direction of the impeller (120) spin. The blades (130) also have a convex shape toward the outer portion of the blade (130) and a concave shape on the inner portion of the blade (130). While this more complex, dual curve blade (130) shape provides noise reduction with vertical cutoffs (140). However, the benefit was less noticeable with the use of the non-vertical cutoffs (140).

Figure 11:
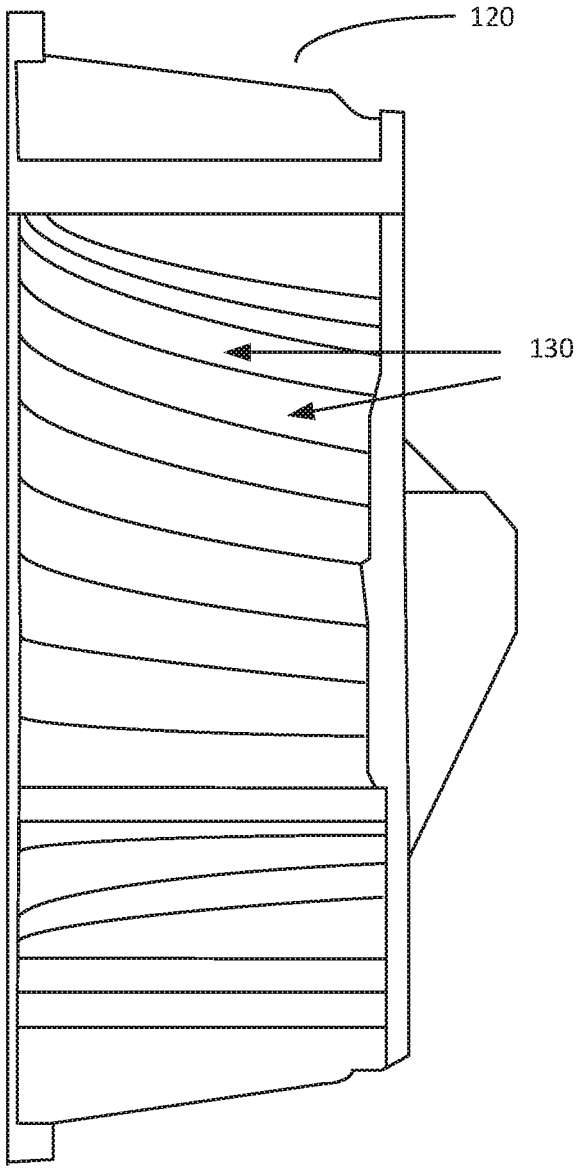
FIG. 11 shows a side view of an impeller according to one example of the principles described herein.

FIG. 11 shows a side view of an impeller (120) according to an example of the principles described herein. The conical section shape of the impeller (120) where the blades have a larger diameter closer to the inlet increases the efficiency of the fan (100). The larger diameter blade (130) edge travels faster at a given revolutions per minute, creating a lower pressure at the inlet. The lower pressure draws in more fluid. This, in turn, increases the airflow and efficiency of the impeller (120) in some designs. This design approach may also reduce the air velocity entering the impeller (120) which results in needing less negative pressure for the same airflow or providing greater airflow at a given negative pressure.

It will be appreciated that, within the principles described by this specification, a vast number of variations exist. It should also be appreciated that the examples described are only examples, and are not intended to limit the scope, applicability, or construction of the claims in any way.

What is claimed is:

1. A fan comprising:

a housing;

an impeller with an axis and a plurality of blades, the impeller mounted inside the housing;

a plurality of outlets from the housing, each outlet comprising a cutoff with a top and a bottom, wherein a line between the top and bottom of each cutoff is not parallel to the axis of the impeller and wherein each cutoff partially covers and partially exposes ends of three fan blades at an opening of each outlet.

2. The fan of claim 1, wherein the plurality of outlets is two outlets.

3. The fan of claim 2, wherein the two outlets are located on opposite sides of the impeller.

4. The fan of claim 3, wherein a cutoff is sloped relative to a direction of rotation of the impeller.

5. The fan of claim 4, wherein a slope of each cutoff is 45 degrees.

6. The fan of claim 3, wherein a cutoff is curved relative to a direction of rotation of the impeller.

7. The fan of claim 3, wherein a shape of cutoff of a first outlet differs from a shape of the cutoff of a second outlet.

8. The fan of claim 7, wherein the cutoff of the first outlet is shaped with a first geometry and the cutoff of the second outlet is shaped with a second, different geometry, where the first and second geometries are not straight edges parallel to the axis of the impeller.

9. The fan of claim 1, wherein a cutoff is shaped to reduce the noise in an audible range for a human being.

10. The fan of claim 1, wherein each cutoff partially covers ends of four fan blades.

11. The fan of claim 1, wherein each cutoff partially covers and partially exposes the ends of the three fan blades at any given time as seen through the opening of the opening of each outlet.

12. The fan of claim 1, wherein each cutoff has a constant slope from the top to the bottom.

13. A housing for a fan, the housing comprising:

a first output port with a first cutoff; and a second output port with a second cutoff, wherein the first cutoff is shaped relative to a direction of flow of fluid exiting the first output port and the first cutoff partially covers and partially exposes ends of three blades of an impeller at an opening of the first output port.

14. The housing of claim 13, wherein the second cutoff is shaped relative to a direction of flow of fluid exiting the second output port and the first and second cutoffs each form different shapes relative to the direction of flow of fluid exiting their respective ports.

15. The housing of claim 14, further comprising the impeller mounted in the housing, the impeller comprising blades wherein each blade is backward inclined and forward curved.

16. The housing of claim 13, wherein the first cutoff partially covers and partially exposes the ends of the three blades of the impeller at any given time as seen through the opening of the first output port.

17. The housing of claim 13, wherein the second cutoff partially covers and partially exposes ends of three blades of the impeller at an opening of the second output port.

18. A method of operating a fan with multiple output ports, the method comprising:

adjusting rotational speed of the fan to produce a first audio profile from the output of a first output port and to produce a second audio profile from the output of a second output port, wherein the first and second audio profiles differ from each other, and wherein each output port comprises a cutoff partially covering and partially exposing ends of three blades of an impeller at the output of each output port.

19. The method of claim 18, wherein a combined audio profiles is optimized at specific fan speeds and is not optimized at other specific fan speeds.

20. The method of claim 18, wherein each output port comprises the cutoff partially covering and partially exposing ends of exactly three blades of the impeller at any given time as seen through the output of each output port.

* * * * *